United States Patent [19]

Reese

[11] Patent Number: 5,013,997

[45] Date of Patent: May 7, 1991

[54] LIQUID COOLED, HIGH POWER, FERRITE PHASE SHIFTER FOR PHASED ARRAY ANTENNAS

[75] Inventor: Robert M. Reese, Philadelphia, Pa.

[73] Assignee: General Electric Company, Moorestown, N.J.

[21] Appl. No.: 459,864

[22] Filed: Jan. 2, 1990

[51] Int. Cl.[5] ..... H01P 1/18

[52] U.S. Cl. ..... 323/212; 323/215; 323/24.1; 323/158

[58] Field of Search ..... 323/212, 215, 216; 333/24.1, 158

[56] References Cited

U.S. PATENT DOCUMENTS 4,353,042 10/1982 D'Oro et al. ..... 333/158 X
4,574,259 3/1986 Rado et al. ..... 333/158 X
4,771,252 9/1988 Morz et al. ..... 333/24.1 X
4,794,352 12/1988 Morz et al. ..... 333/24.1 X
4,837,528 6/1989 Morz et al. ..... 333/24.1

*Primary Examiner*—Steven L. Stephan
*Assistant Examiner*—Emanuel Todd Voeltz
*Attorney, Agent, or Firm*—William H. Meise

[57] ABSTRACT

A compact, liquid cooled, ferrite phase shifter is capable of handling high power microwave signals without thermally stressing the ferrite core. The ferrite core is mounted on spacers inside of a hermetically sealed wave guide filled with a thermally conducting fluid. Heat transfer from the core to the housing is symmetrical thereby eliminating or minimizing thermal bending stresses on the phase shifter. Heat from the core is also coupled through the fluid to the phase shifter window for deicing the window.

6 Claims, 2 Drawing Sheets

LIQUID COOLED, HIGH POWER, FERRITE PHASE SHIFTER FOR PHASED ARRAY ANTENNAS

This invention relates to a ferrite phase shifter for phased array antennas and, more particularly, to a phase shifter capable of handling high power without suffering performance degradation due to thermally induced stress in the ferrite core.

BACKGROUND OF THE INVENTION

Phased array antennas consist of an array of fixed radiating elements in which the radiation pattern of a microwave beam is determined by the phase relationship of the signals that excite the radiating elements. The radiating elements include phase shifters operating under computer control so that the beam is scanned in azimuth and elevation without mechanical movement of the radiating elements. The phase shifting elements are preferably ferrites which are a class of materials consisting of compressed and sintered powders of a magnetic material, chiefly ferric oxide, and one or more metals. The ferrite materials may come in various combinations, but three major classes of such ferrites are spinels, garnets, and hexagonal ferrites depending on the crystal structure of the ferrite.

Of these various classes of ferrites, the garnet ferrites have become very useful and very popular because they have the most advantageous characteristics —namely, low RF losses, and they are smaller, lighter, and more reliable than other types of ferrite phase shifters. The ferrite elements are positioned in a wave guide and control the phase of the incoming RF signal by means of a magnetic field periodically applied along the ferrite element. The magnetic fields may be developed, in the case of metallized cylindrical ferrite rods, by surrounding the ferrite rod with a coil or by passing a latch wire through the center of a rectangular ferrite annulus. DC latching pulses are applied to the latch wire to produce the magnetic field which shifts the phase of the incoming RF signal.

While garnet ferrites are useful in phased array antenna systems, demand for improved performance requires that the phase shifters handle ever increasing power levels. Ultimately, the power handling capacity is limited by the ability to maintain the operational temperature of the phase shifters within prescribed limits. That is, since heat is generated in the garnet ferrite cores, the cores are subject to mechanical stresses due to thermally induced bending. These stresses reduce the performance of the phase shifter. The problem of thermally induced stresses are exacerbated as the power level for these garnet ferrite cores has reached 25 watts and higher.

Various cooling schemes have been developed in the past to remove the heat from the core in an attempt to limit the thermally induced stresses. Among these schemes are forced-air cooling of the phase shifter housing and positioning the garnet core along a surface of the housing so that the housing acts as a heat sink conducting heat to the exterior where the forced air cooling removes the heat. However, as the power levels increase, convective cooling becomes very inefficient. Furthermore, as the density of the radiating elements increases in higher frequency radar applications, the air path between the phase shifter housing virtually disappears making forced air cooling very difficult.

For example, single surface conductive cooling of the core by placing one surface against the housing is adequate up to approximately 25 watt average dissipated power for 10 inch long S band garnet cores. Above this power level, the thermally induced bending stress resulting from the nonsymmetric temperature gradient in the core because only one surface is heat sinked to the wall degrades phase shifter performance. Furthermore, the reliability of the ferrite phase shifters is also drastically reduced since the bending and other stresses can result in micro-cracks and catastrophic failure of the core.

Enlarging the ferrite core and the housing to reduce heat density in the core and hence, the thermal stresses, is not a very palatable solution as this results in a large and heavy antenna design. A need therefore exists for a small, compact ferrite phase shifter design which is cooled in such a manner that it is capable of handling very high power levels, in excess of 25 watts, without subjecting the ferrite core to the undesired thermal bending stresses due to uneven heat gradients across the cross-section and length of the core. Applicant has found that all of these desirable characteristics may be realized by mounting the ferrite phase shifter in a hermetically sealed housing and immersing it in a liquid to provide symmetrical heat transfer from all sides of the ferrite phase shifter to the walls of the housing. In this fashion, the ferrite phase shifter is cooled symmetrically and is not subject to any thermal stresses.

OBJECTIVES

It is, therefore, an objective of the invention to provide a high power ferrite phase shifter which is not subject to thermal stresses.

The principal objective of this invention is to provide a ferrite phase shifter that functions reliably at high power levels (25 watts average power and higher).

It is a further objective of the invention to provide a high power ferrite phase shifter which is symmetrically cooled to minimize thermal stresses on the ferrite which would degrade performance.

Yet another objective of the invention is to cool a high power ferrite phase shifter symmetrically by immersing it in a heat transferring liquid.

Other objectives and advantages of the invention will become apparent as the description thereof proceeds.

SUMMARY OF THE INVENTION

The various objectives and advantages of the invention are realized in an arrangement in which a ferrite phase shifter is mounted in teflon spacers inside a hermetically sealed housing, and the space between the core and the phase shifter housing is filled with a dielectric heat transfer fluid. Because the phase shifter is surrounded by the heat transfer fluid on all sides, heat transfer is symmetric in all directions and no thermal stresses due to temperature gradients in the ferrite core resulting from uneven heat removal is present thus allowing the ferrite phase shifter to dissipate large amounts of power without any risk of damage.

Applicant has thus found that by immersing the ferrite in a liquid, an improved thermal path to the housing walls it provided as compared to present designs which require the use of air gaps. The ferrite core cross sectional temperature gradients, which induce thermal bending stresses, are eliminated by the symmetry of the cooling paths. Because the phase shifter is hermetically sealed and self-contained, it results in a readily replaceable unit which can be accessed directly from the array face without removing beam former components. The phase shifter is also self-deicing (and ice inhibiting) while in operation by virtue of the heat transferred by the liquid to the alumina window or ceramic transformer associated with the ferrite phase shifter.

DETAILED DESCRIPTION OF THE INVENTION

Figure 1:
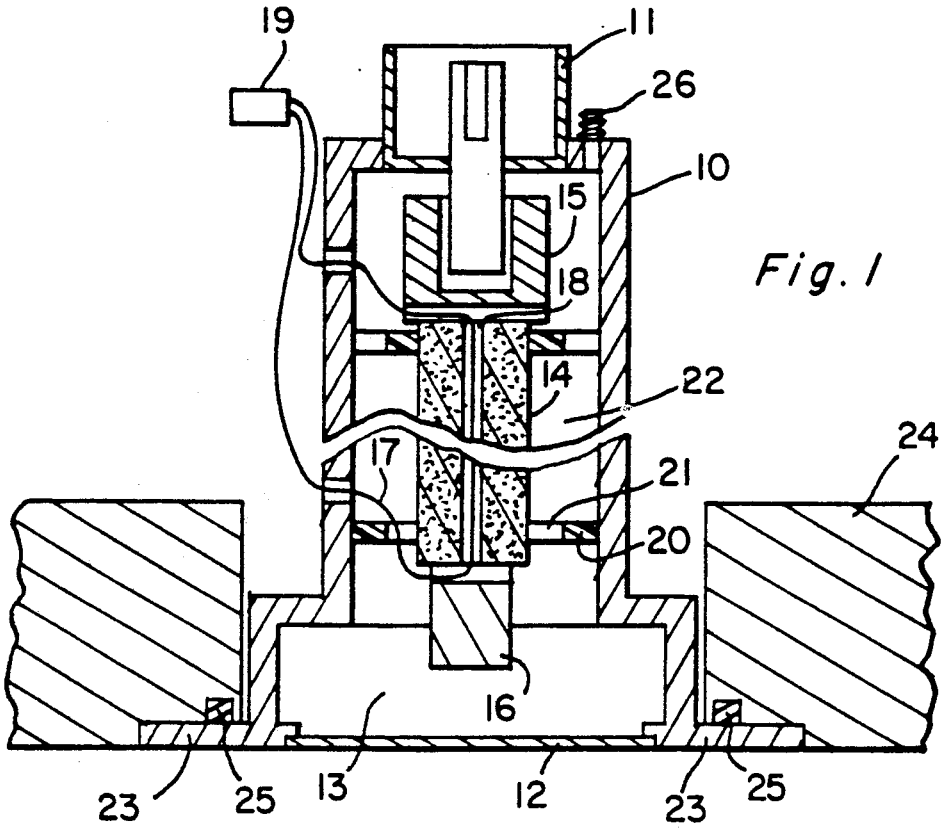
FIG. 1 is a sectional view of a non-reciprocal ferrite phase shifter taken along the lines 1—1 of FIG. 2.
Figure 2:
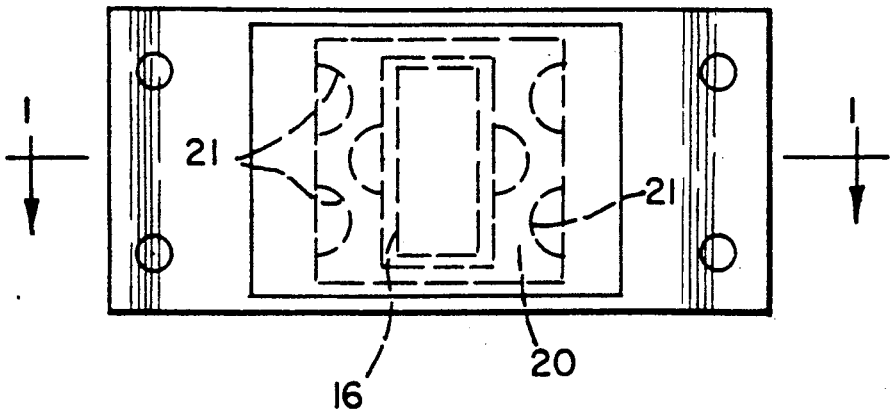
FIG. 2 is a plan view of the radiating end of the non-reciprocal phase shifter.

FIG. 1 shows a non-reciprocal ferrite phase shifter assembly according to the invention and includes a wave guide housing 10 which is hermetically sealed at the top by a push on RF connector 11 and at the bottom by an alumina window 12 which communicates with the radiating element in the form of a horn cavity 13. RF connector 11 is coupled to a ferrite phase shifter 14 in the form of two rectangular slabs by means of a reentrant quarter wave connector transition 15. Ferrite phase shifter 14 is coupled to the radiating horn cavity by means of a quarter wave phase shifter transition 16 extending into cavity 13.

The phase shifting characteristics of the ferrite is controlled by means of a latch wire 17 extending axially through a central passage 18 in the ferrite. Latch wire 17 extends through the wave guide housing wall to a latch connector 19 outside of the wave guide. Latch wire 17 which passes through the ferrite is periodically energized by DC latching pulses applied through connector 19 to establish a magnetic field along the axis of the ferrite to produce the desired phase shift of the incoming RF energy coupled to the wave guide by means of push on connector 11. Phase shifted RF energy is then transmitted to the antenna radiating element in the form of the horn cavity 13 and projected out.

Ferrite cores 14 are supported in the microwave guide by means of teflon spacers 20 which have a plurality of openings 21 around the inner and outer periphery. The wave guide is filled by a dielectric heat transferring liquid 22 which thus surrounds the ferrite on all sides. Dielectric liquid 22 may typically be a fluorocarbon such as FC-77. A dielectric liquid is required in the embodiment of FIG. 1 since housing 10 acts as a wave guide and the electric field penetrates through the interior of the housing and through the liquid. Liquid 22 also has good heat transfer characteristics and transfers heat generated in the ferrite to the outer walls of the cavity and then to housing flanges 23. These mounting flanges are in turn coupled to a liquid cooled aperture plate 24 thereby removing heat from the housing. That is, heat generated in the ferrite core is transferred through the liquid to the housing and the flange and then to the liquid cooled aperture plate 24 which is sealed to the flanges through the O rings 25. Because the ferrite slabs 14 are completely surrounded by liquid, heat transfer is symmetrical in all directions, and no thermal stresses are induced in the ferrite due to temperature gradients established in the ferrite by nonsymmetrical heat removal.

One additional advantage of the liquid cooled ferrite phase shifter assembly is that it not only couples heat to the walls of wave guide 10 and to the flange 23 but also to the alumina window 12. The heat transferred to the alumina window keeps it sufficiently warm to provide deicing of the window whenever the phase array antenna incorporating individual ferrite phase shifter is located in cold environments. Bellows 26 communicates with the interior of the housing to allow for expansion and contraction of the liquid with temperature changes.

Figure 3:
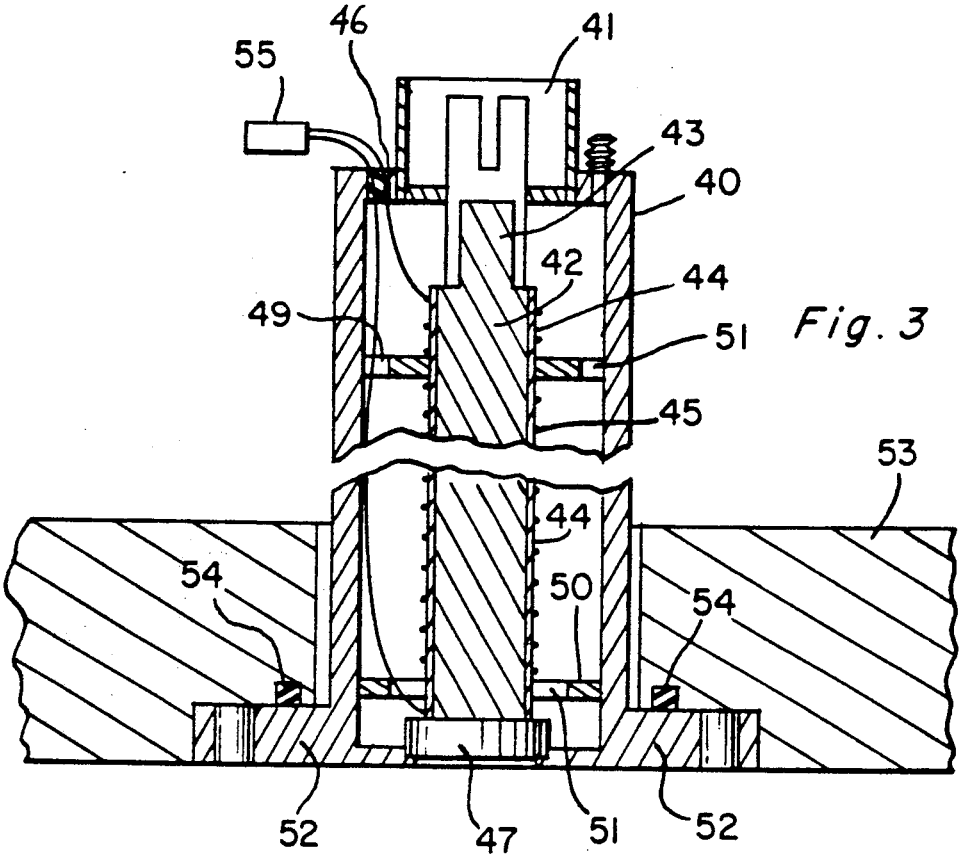
FIG. 3 is a sectional view of a reciprocal phase shifter taken along lines 3—3 of FIG. 4.
Figure 4:
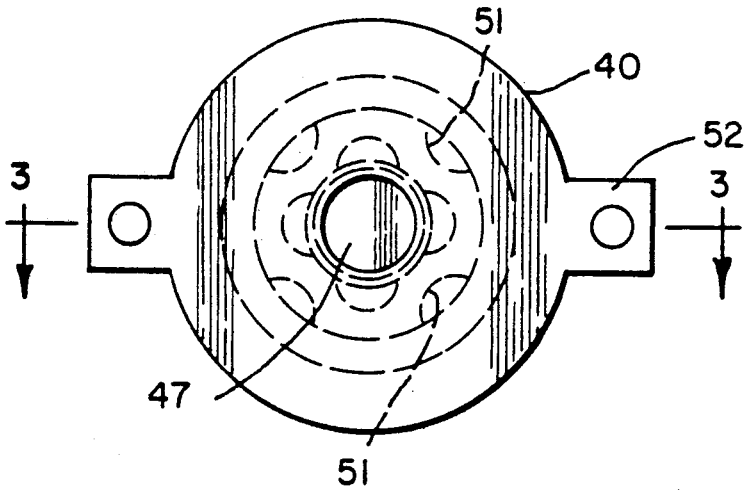
FIG. 4 is a plan view of the radiating end of a reciprocal ferrite phase shifter of FIG. 3.

FIG. 3 shows a dual mode reciprocal phase shifter assembly utilizing a ferrite (garnet) core with a metallized outer surfaces so that the RF energy is propagated through the ferrite within the metallized outer surface and the chamber wall no longer affects the RF performance of the device. Hence, the liquid used in the assembly of FIG. 3 need not have a high dielectric constant. The only requirement for the liquid in this embodiment is that it has a good thermal heat transfer characteristics. In fact, because there is no requirement for dielectric liquid, hence liquids with higher heat transfer coefficients may be utilized for more efficient transfer of heat from the ferrite to the housing wall.

FIG. 3 shows a reciprocal ferrite (garnet) phase shifter mounted in a cylindrical housing 40 which is hermetically sealed at the top by means of a push on RF connector 41. RF connector 41 is coupled to a cylindrical ferrite phase shifter 42 through a quarter wave connector transition 43 projecting into the RF connector. Cylindrical ferrite phase shifter 42 has an outer metallized coating 44 and is surrounded by a coil 45 which extends through housing 40 through a coil connector 46. Coil 45 controls the phase shift of the RF energy coupled to the ferrite phase shifter as it is periodically energized. The target and core transition uses a ceramic matching transformer 47 which is metallized along the outer diameter in place of the horn cavity and alumina window shown in FIG. 1. The radiating element in the from of the ceramic transformer 47 also seals the lower end of the housing to provide the hermetically sealed inner chamber in which a heat transferring liquid 48 is contained. The ferrite phase shifter 42, in a manner similar to FIG. 1, is supported by a pair of teflon phase shifter supports 49 and 50 which contain a plurality of openings 51 around the inner and outer periphery to permit flow of the liquid throughout the chamber.

As has been pointed out previously, RF energy propagation in a metallized cylindrical ferrite is in completely within the ferrite phase shifter. That is, the metal layer on the outer surface of the ferrite constitutes the wave guide for the RF energy. Hence, the liquid in the chamber need not have high dielectric constants, and its only characteristic is that it has the optimum heat transfer characteristic possible. In fact, with a metallized ferrite liquids with higher thermal conductives can be used than is the case when the liquid must be both a dielectric as well as a heat transfer medium. Thus, with the use of liquids having higher heat transfer coefficients, the size of the outer housing can be reduced since a lesser quantity of liquid can now transfer the same amount of heat thereby reducing the thermal resistance to the housing walls. The heat transferred to the housing 40 is again transferred to housing flanges 52 which in turn communicate with a liquid cooled aperture plate 53 to remove the heat from the housing. Aperture plate 53 is sealed to flange 52 by means of the "O"-rings 54 in the aperture plates.

Heat transferred through the liquid in the housing also warms a matching transformer 47 thereby providing a deicing function for the outwardly facing surface of transformer 47. This feature is significant when the individual phase shifters forming part of a phase array antenna are utilized in severe environments where a build-up of ice on the array face would severely degrade antenna performance.

It will now be apparent that a small, light weight, high-power ferrite phase shifter construction has been described which is capable of handling RF power loads of 25 watts or more without undergoing thermal stresses which can cause catastrophic failures of the ferrite phase shifter due to uneven heat dissipation from the phase shifter and the consequent temperature gradients which cause thermal stresses. This is achieved by means of the instant invention by symmetrical cooling of the phase shifter which is surrounded by a heat transfer liquid on all sides.

Additionally, this design allows for direct access to the phase shifters for maintenance from the target side. Disassembly of cumbersome beam former (wave guide) is not required because of the rear push-on RF connector.

Further, this invention of a liquid-cooled ferrite phase shifter is applicable to garnet phase shifters of arbitrary design.

What is claimed as new and is desired to be secured by U.S. patents is:

1. A high power ferrite phase shifter comprising:

(a) a hermetically sealed housing;

(b) means for mounting a ferrite phase shifter element in said housing;

(c) means adapted for coupling RF energy to said housing and said ferrite;

(d) means for applying a magnetic field to said ferrite for selectively shifting the phase of said RF energy in response to said magnetic field;

(e) means for symmetrically removing heat from said ferrite including a thermally conductive liquid sealed in said housing surrounding said ferrite to transmit heat from said ferrite to said housing; and (f) radiating means coupled to said phase shifter element.

2. The phase shifter according to claim 1 wherein said housing is a wave guide and the said thermally conductive liquid is a dielectric.

3. The ferrite phase shifter according to claim 1 wherein said ferrite is metallized on its outer surface and is surrounded by a coil for applying a magnetic field to said metallized ferrite phase shifter.

4. The ferrite phase shifter according to claim 2 wherein a . passage extends through said ferrite, a latch wire positioned in said passage to apply a magnetic field to said ferrite to DC latching pulses applied to said wire.

5. The ferrite phase shifter according to claim 4 wherein the radiating means coupled to said phase shifting element and said housing is a horn cavity sealed at its radiating end by a radiation transparent window.

6. The ferrite phase shifter according to claim 4 wherein the radiating means coupled to said phase shifter is a ceramic transformer sealing the bottom of said housing.

* * * * *